US008783532B2

(12) United States Patent
Gregory et al.

(10) Patent No.: US 8,783,532 B2
(45) Date of Patent: Jul. 22, 2014

(54) MULTI-DISK ACCESSORY ATTACHMENT PLATFORM

(75) Inventors: Thomas M. Gregory, Belgrade, MT (US); Robert A. Kincaid, Bozeman, MT (US); Clifton L. Cook, Sheridan, WY (US); Eric M. Yeates, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 10 days.

(21) Appl. No.: 13/519,381

(22) PCT Filed: Jan. 13, 2011

(86) PCT No.: PCT/US2011/000062

§ 371 (c)(1),
(2), (4) Date: Jun. 27, 2012

(87) PCT Pub. No.: WO2011/087907

PCT Pub. Date: Jul. 21, 2011

(65) Prior Publication Data

US 2012/0292356 A1 Nov. 22, 2012

Related U.S. Application Data

(60) Provisional application No. 61/335,855, filed on Jan. 13, 2010.

(51) Int. Cl.
*F41C 33/04* (2006.01)

(52) U.S. Cl.
CPC ..... *F41C 33/045* (2013.01)
USPC ..... 224/198

(58) Field of Classification Search
CPC ..... F41C 33/045
USPC ..... 224/197–200
See application file for complete search history.

(56) References Cited

U.S. PATENT DOCUMENTS

| | | | | | |
|---|---|---|---|---|---|
| 2,410,640 | A | * | 11/1946 | Engle | 224/198 |
| 2,641,395 | A | * | 6/1953 | Engle | 224/198 |
| 3,117,708 | A | | 1/1964 | Goldman et al. | |
| 3,261,519 | A | | 7/1966 | Home | |
| 4,504,001 | A | * | 3/1985 | Nichols | 224/198 |
| 5,018,653 | A | * | 5/1991 | Shoemaker | 224/198 |
| 5,193,725 | A | * | 3/1993 | Radocy | 224/197 |
| 5,274,885 | A | | 1/1994 | Hellweg | |
| 5,641,102 | A | * | 6/1997 | Hellweg | 224/198 |
| 6,010,045 | A | * | 1/2000 | Rogers et al. | 224/198 |
| 6,685,067 | B2 | | 2/2004 | French | |
| 6,817,499 | B2 | * | 11/2004 | Martinez | 224/197 |
| 7,690,541 | B2 | * | 4/2010 | Pellegrini | 224/198 |

(Continued)

*Primary Examiner* — Justin Larson
(74) *Attorney, Agent, or Firm* — Shaddock Law Group, PC

(57) ABSTRACT

An accessory attachment platform, including a platform body having an accessory portion, wherein the accessory portion includes an accessory disk opening; an attachment plate portion coupled to an accessory plate portion, through the accessory disk opening, such that the attachment plate portion and the accessory plate portion are rotatable relative to the platform body; and a release lever pivotably attached to the platform body, wherein the release lever is pivotable between a locking position and an unlocking position, and wherein the release lever is capable of releasably interacting with a primary notch of the attachment plate portion such that when the release lever is in the locking position relative to the primary notch of the attachment plate portion, the attachment plate portion is unable to rotate relative to the platform body.

15 Claims, 15 Drawing Sheets

(56) References Cited

U.S. PATENT DOCUMENTS

| | | | | |
|---|---|---|---|---|
| 8,100,304 | B2 * | 1/2012 | Tanzini | 224/200 |
| 8,251,266 | B2 * | 8/2012 | Gregory et al. | 224/198 |
| 8,469,245 | B2 * | 6/2013 | Gregory et al. | 224/198 |
| 8,517,234 | B2 * | 8/2013 | Kincaid et al. | 224/198 |
| 2004/0251284 | A1 | 12/2004 | Pelligrini | |
| 2006/0196903 | A1 | 9/2006 | Tanzini | |
| 2007/0023468 | A1 | 2/2007 | Ford | |

* cited by examiner

MULTI-DISK ACCESSORY ATTACHMENT PLATFORM

CROSS-REFERENCE TO RELATED APPLICATIONS

This application claims priority from U.S. Provisional Patent Application Ser. No. 61/335,855, filed Jan. 13, 2010, the disclosure of which is incorporated herein in its entirety by reference.

BACKGROUND OF THE INVENTION

1. Field of the Invention

The present invention is directed generally to a rigid or semi-rigid platform for attaching a handgun holster or other accessory carrier to a belt, a waistband of a pair of trousers, another article of clothing, to a MOLLE or S.T.R.I.K.E. webbing attachment, or to a harness or one or more pieces of webbing or strap material. More specifically, the present invention is directed to a multi-axis platform that allows an attached holster or other accessory carrier to be selectively rotated between at least two positions relative to the wearer's body.

2. Description of Related Art

Many handgun users, particularly military and law enforcement personnel, carry a handgun in a holster designed to protect the handgun and hold it securely. Holsters can be worn in a number of ways and in a variety of locations on a user's body, such as on the chest, under an arm, at the waist, on the thigh, or around an ankle.

Unfortunately, most modern holsters and holster carriers can be uncomfortable to wear, particularly by someone who must wear the holster while in a seated position. For example, when a law enforcement officer sits in a vehicle, the holster, which is typically attached to the officer's belt in the officer's hip region, generally contacts the seat and is forced upward by the seat. This typically causes the officer's belt to be pushed up and/or the rear of the handgun to be pushed into the officer's side, resulting in great discomfort to the officer.

SUMMARY OF THE INVENTION

The prior holster holders and carriers fail to provide a user with the ability to readily and easily rotate or re-position a holster or other attached accessory carrier from an exemplary, carry position to a rotated or angular position. The prior holster holders fail to provide a holster holder or carrier that provides a user with the ability to readily and easily rotate a holster or other attached accessory carrier from a rotated or angular position to an exemplary, carry position.

Accordingly, the present invention is directed generally to a rigid or semi-rigid holder, carrier, or platform usable for attaching a handgun holster or other accessory carrier to a belt, a waistband of a pair of pair of trousers, another article of clothing, to a MOLLE or S.T.R.I.K.E. webbing attachment, or to a harness or one or more pieces of webbing or strap material. More specifically, the platform includes several adjustment points that allow a relative rotational angle between the platform and an attached holster or other accessory carrier to be changed.

Generally, the platform comprises a platform body, two interchangeable, rotatable disks that act as an attachment plate and an accessory plate. In various exemplary embodiments, the rotatable disc that acts as the attachment plate is attached or couple to a belt loop. However, it should be appreciated that the attachment plate may be attached or couple to any number of attachment devices.

Thus, in certain exemplary embodiments, a holster or other accessory carrier may be attached or coupled to the accessory plate such that the attachment plate and the accessory plate may independently be turned or rotated with respect to the platform body to allow a user to be more comfortable while in, for example, a seated position, while still having access to a holstered handgun or a carried accessory. Then, when the user returns to a standing position, the holster or other accessory carrier can easily be returned to an exemplary, carry position.

In certain exemplary embodiments, a holster or other accessory carrier may be maintained in a movable position allowing for movement of the holster or carrier as the a user moves, thereby allowing for a constant repositioning and allowance for, for example, seat position, movement of the wearer, or interfering objects.

In various exemplary, non-limiting embodiments of this invention, a holster or other accessory carrier may be adjustably rotated or turned to one of a number of predetermined angles. That is to say, an angle between the platform and an attached holster or an angle between the platform and an attached belt loop may be adjusted between several determined adjustment points.

Thus, the present invention comprises a new and improved platform that allows an attached holster or other accessory carrier to be rotated to one or more determined angles relative to the platform, while simultaneously allowing an attached belt loop or other attachment means to be rotated to one or more determined angles relative to the platform.

Because the angle between the platform body and the attachment plate can be adjusted independently of the angle between the platform body and the accessory plate, the rotatable platform and an attached holster can be rotated in the manner illustrated in FIGS. 7 and 8 such that the holster (and ultimately any handgun seated within the holster) can be maintained in a normal orientation (wherein the axis of the handgun barrel is in a substantially vertical position), while being rotated forward and upward from an exemplary, carry position.

Accordingly, this invention provides a platform, having a simple and reliable holster or accessory carrier attachment system.

This invention separately provides a platform body that allows a holster or other accessory carrier to be selectively rotated between at least an exemplary, carry position and a plurality of rotated positions relative to the platform body.

This invention separately provides a platform, which is capable of being manufactured using injection molding and/or thermoform production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
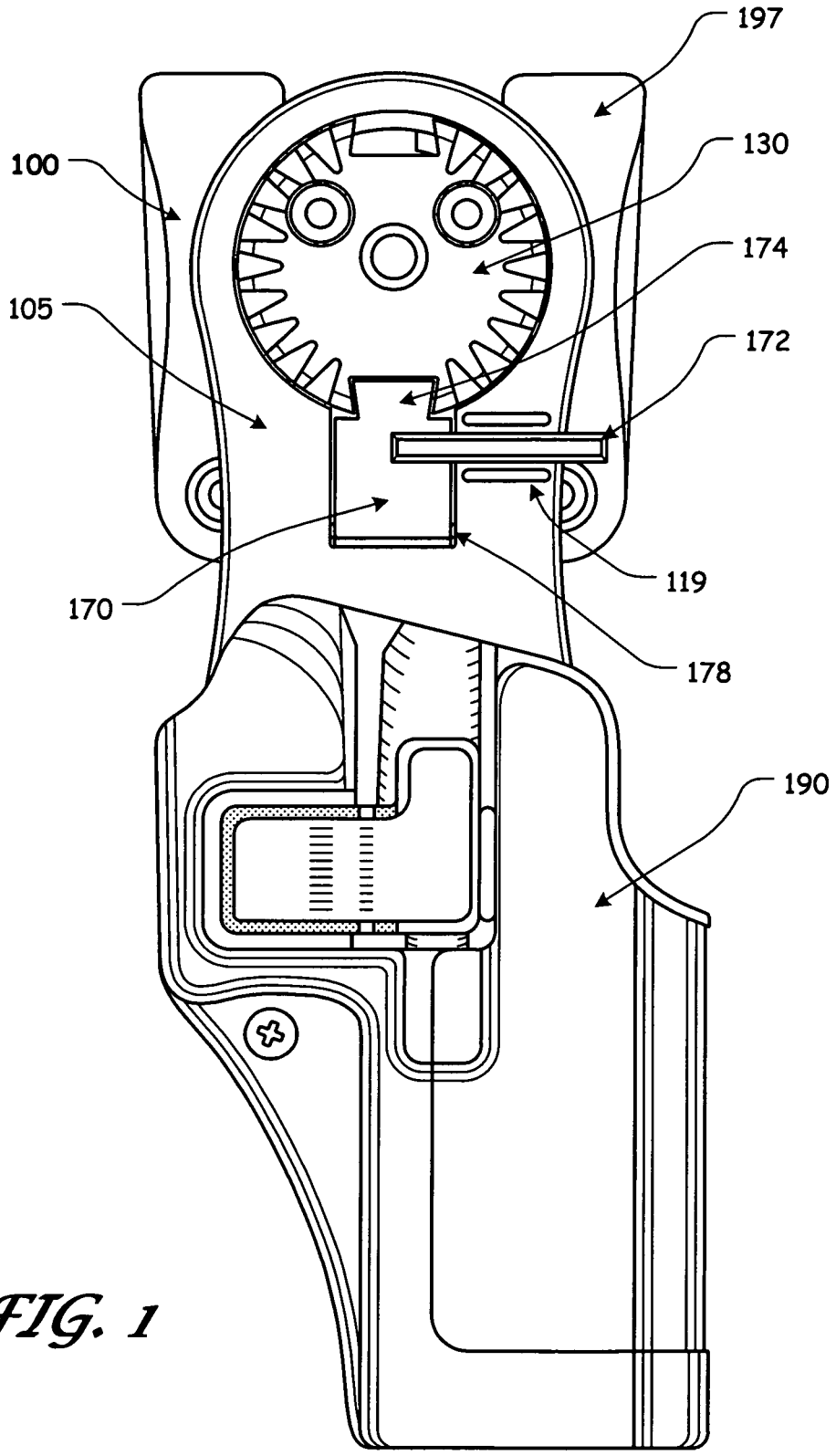
FIG. 1 shows a front view of the rotatable accessory attachment platform, together with an exemplary belt loop and holster, wherein the attached holster is shown in an exemplary, carry position.
Figure 2:
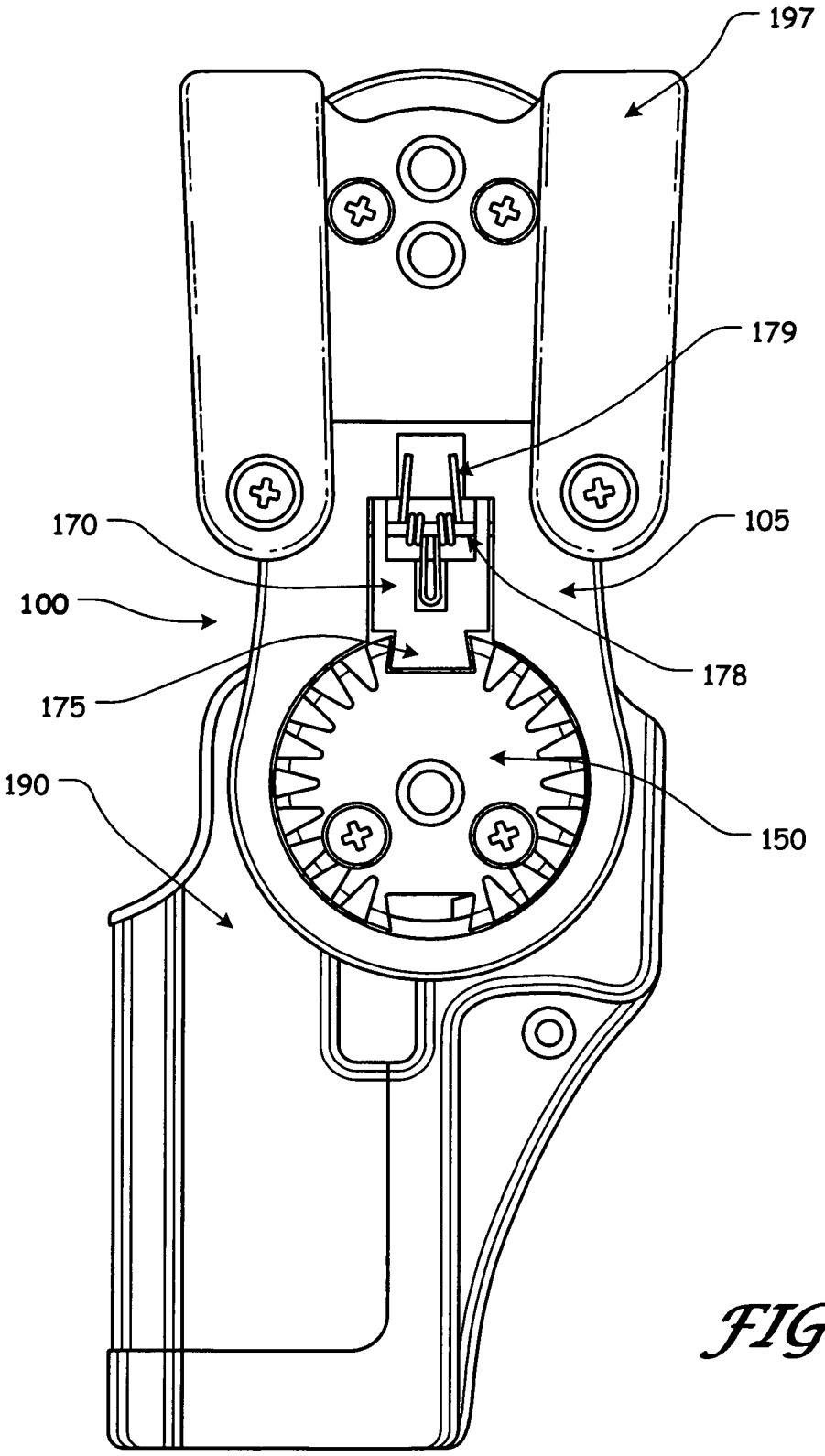
FIG. 2 shows a back view of the rotatable accessory attachment platform, together with an exemplary belt loop and holster, wherein the attached holster is shown in an exemplary, carry position.
Figure 3:
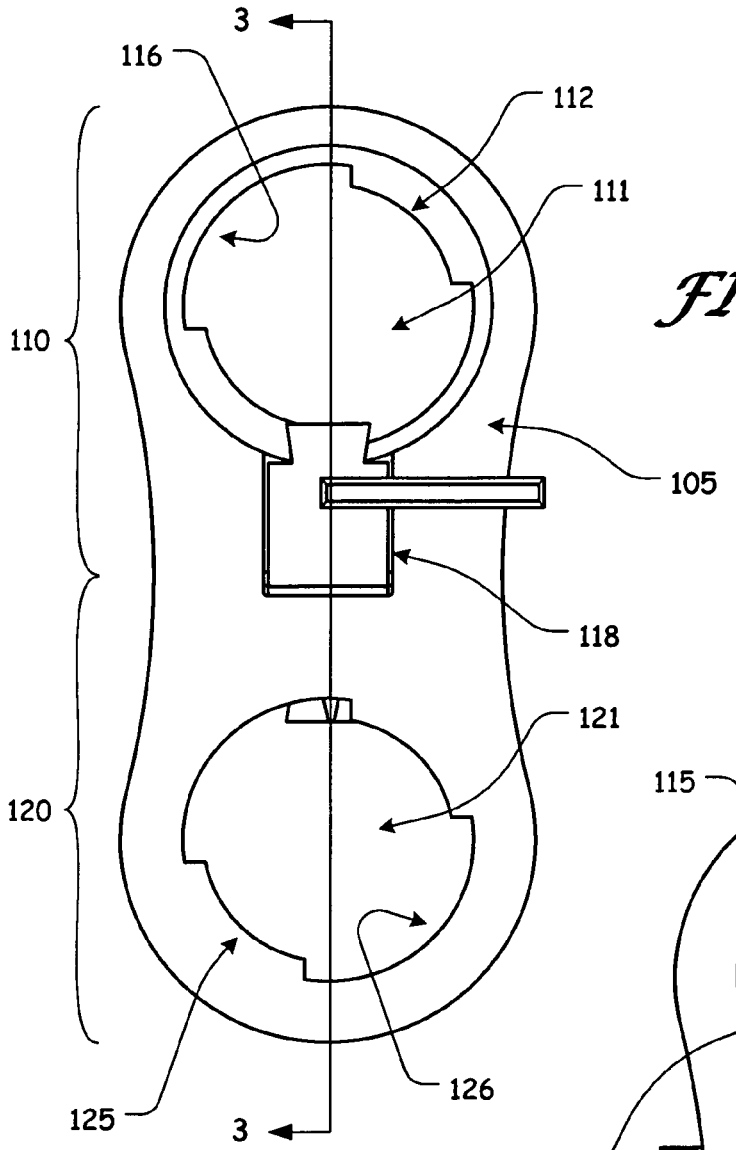
FIG. 3 shows a front view of the platform body and release lever of the rotatable accessory attachment platform.
Figure 4:
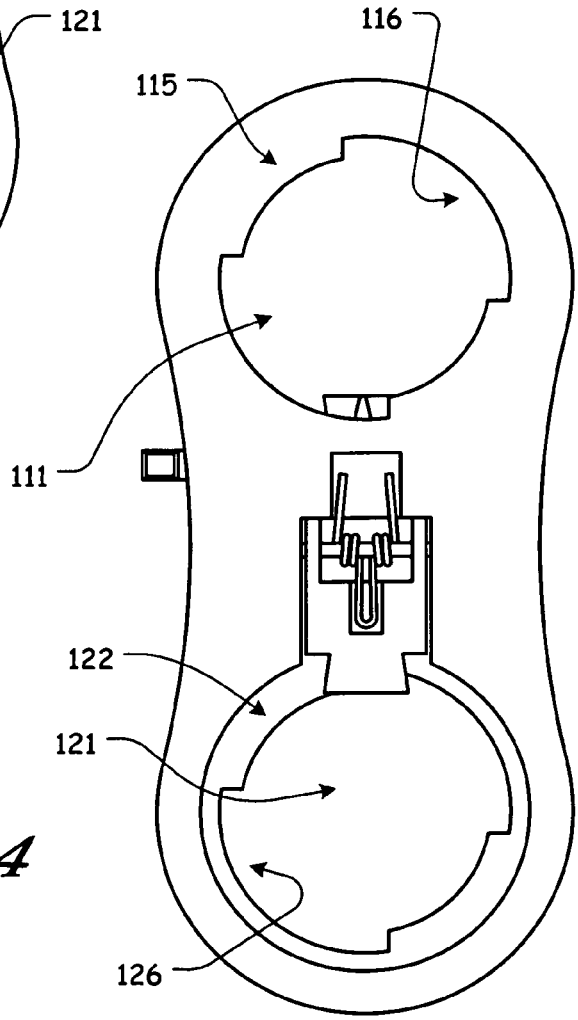
FIG. 4 shows a back view of the platform body and release lever of the rotatable accessory attachment platform.
Figure 5:
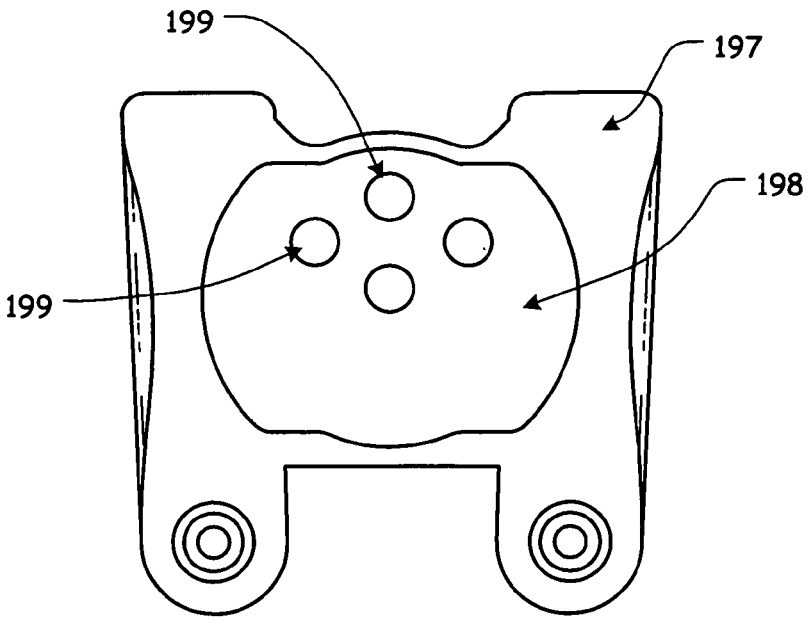
FIG. 5 shows a front view of an exemplary belt loop of the rotatable accessory attachment platform.
Figure 6:
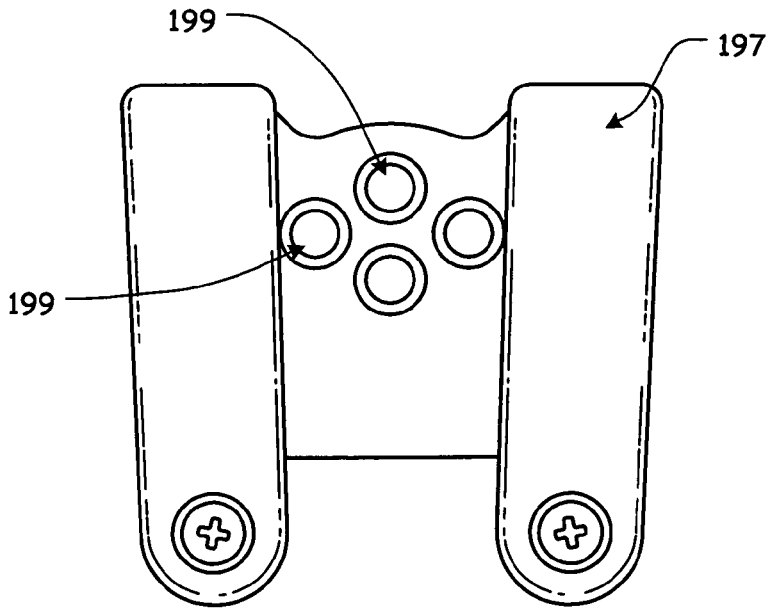
FIG. 6 shows a back view of an exemplary belt loop of the rotatable accessory attachment platform.
Figure 7:
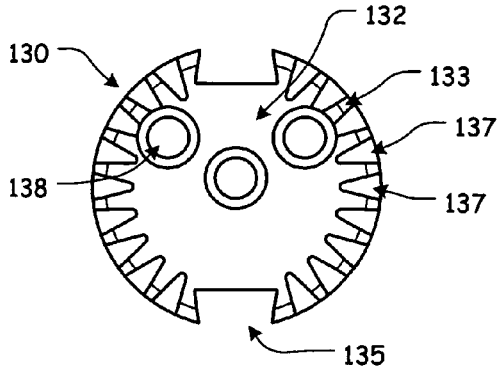
FIG. 7 shows a front view of an exemplary attachment plate of the rotatable accessory attachment platform.
Figure 10:
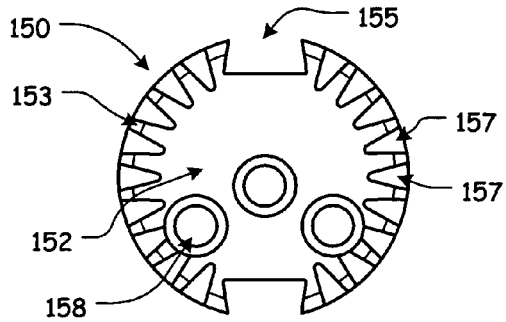
FIG. 10 shows a front view of an exemplary accessory plate of the rotatable accessory attachment platform.
Figure 8:
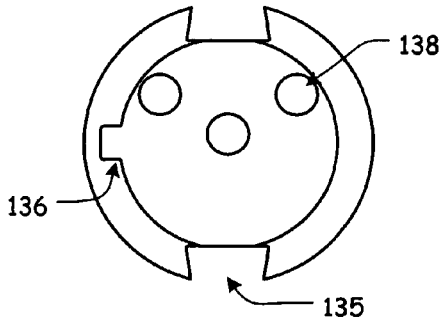
FIG. 8 shows a back view of an exemplary attachment plate of the rotatable accessory attachment platform.
Figure 11:
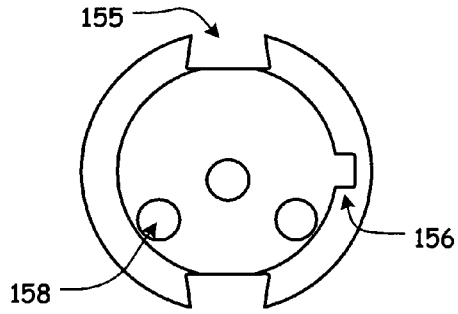
FIG. 11 shows a back view of an exemplary accessory plate of the rotatable accessory attachment platform.
Figure 9:
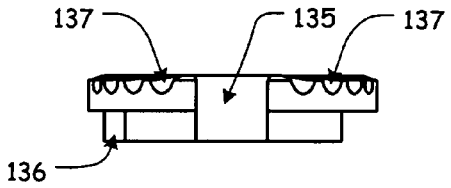
FIG. 9 shows a side view of an exemplary attachment plate of the rotatable accessory attachment platform.
Figure 12:
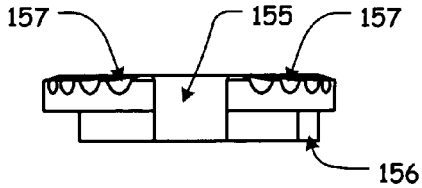
FIG. 12 shows a side view of an exemplary accessory plate of the rotatable accessory attachment platform.
Figure 13:
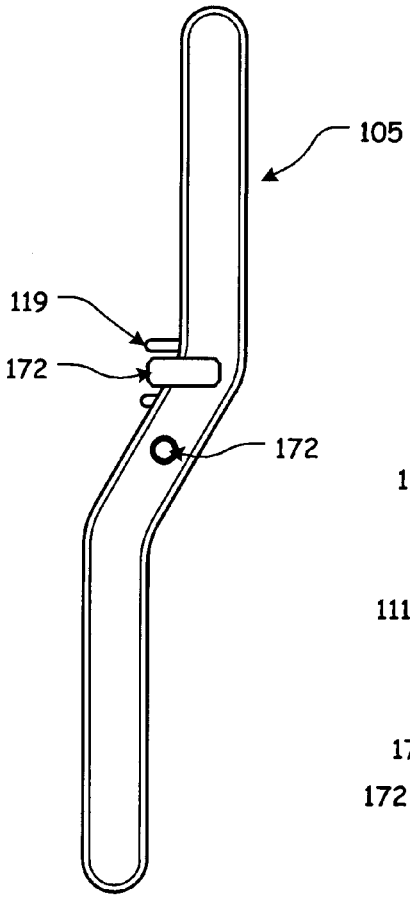
FIG. 13 shows a side view of the platform body and release lever of the rotatable accessory attachment platform, where in the release lever is in the closed position.
Figure 14:
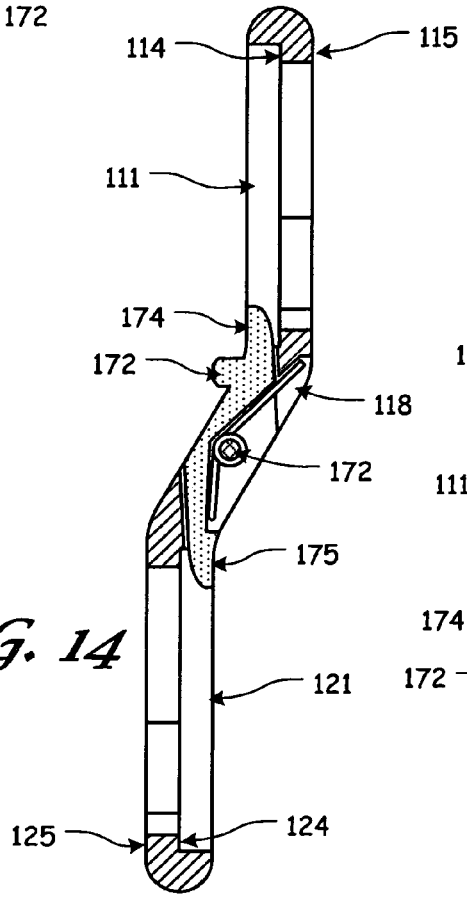
FIG. 14 shows a shows a cross sectional view taken at line 3-3, of FIG. 3, where in the release lever is in the closed position.

The design factors and operating principles of the present invention are explained with reference to various exemplary embodiments of a multi-disk, rotatable accessory attachment platform.

It should be appreciated that, for simplicity and clarification, the embodiments of this invention will be described with reference to a handgun holster being attached to the rotatable accessory plate and a belt loop being attached to the rotatable attachment plate. However, it should be appreciated that any handgun holster, other holster, accessory or other carrier, platform, pouch, carrier rail (i.e., a Picatinny rail), or device may be removably or permanently attached or coupled to the rotatable accessory plate. In certain exemplary embodiments, the attachment plate may be attached to a universal mounting platform that is capable of being removably attached or coupled to a portion of MOLLE or S.T.R.I.K.E. webbing. In various exemplary embodiments, the universal mounting platform is as described in U.S. patent application Ser. No. 11/906,629, filed Oct. 3, 2007, entitled Universal Mounting Platform, the disclosure of which is incorporated herein by reference. Likewise, it shall also be appreciated that any belt loop or other attachment or coupling means may be removably or permanently attached or coupled to the rotatable attachment plate.

Thus, it should be understood that the rotatable accessory attachment platform of this invention may be utilized in conjunction with any carrier or holder for any handgun, edged weapon, ammunition magazine, less than lethal product (i.e., a taser, pepper spray, mace canister, baton, or the like), radio, flashlight, cellular telephone, personal digital assistants, or other device. Likewise, the rotatable accessory attachment platform of this invention may be utilized in conjunction with any belt loop or other coupling means, or may be permanently or removably affixed to any structure.

It should also be appreciated that the terms "carrier", "holder", "holster", and "platform" are used for basic explanation and understanding of the operation of the systems, methods, and apparatuses of this invention. Therefore, the terms "carrier", "holder", "holster", and/or "platform" are not to be construed as limiting the systems, methods, apparatuses, or applications of this invention.

Referring now to the drawing figures, FIGS. 1-27 show various views of the component parts and/or an assembled first exemplary embodiment of a rotatable accessory attachment platform according to this invention. As shown in FIGS. 1-27, the rotatable accessory attachment platform 100 includes at least some of a platform body 105, an attachment plate 130, an accessory plate 150, and a release lever 170.

The platform body 105 comprises a first side, a second side, an attachment portion 110, and an accessory portion 120.

Typically, the first side is considered the outer side of the platform body 105 and is worn facing away from a user's body, while the second side is considered the inner side of the platform body 105 and is worn facing against or adjacent the user's body.

Typically, the front portion is worn facing towards the front of a user's body, while the rear portion, is worn facing towards the rear of the user's body.

Figure 26:
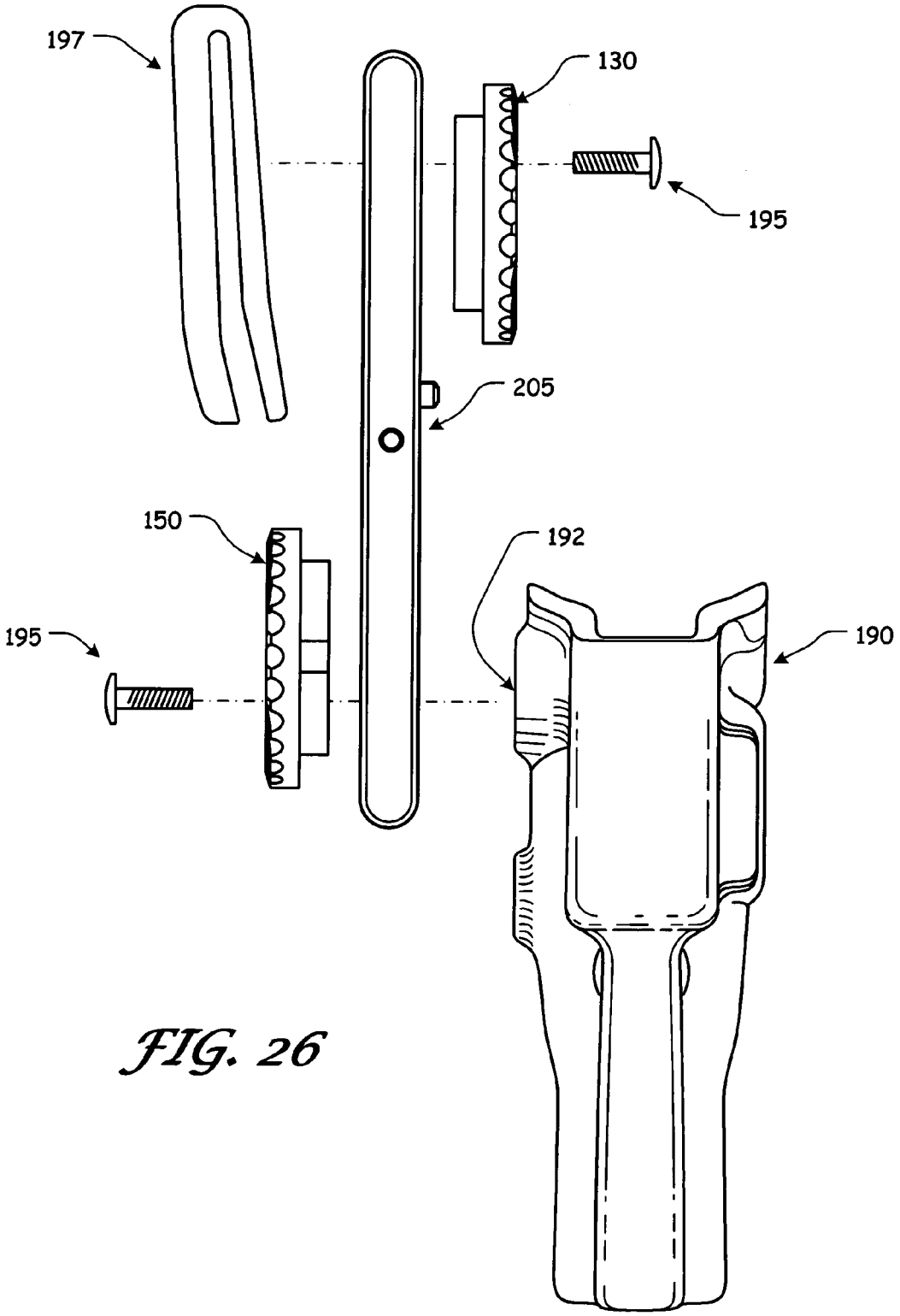
FIG. 26 shows a side view of the constituent components of a second exemplary embodiment of an accessory attachment platform according to this invention, together with an exemplary belt loop and holster.

The platform body 105 extends from the attachment portion 110 to the accessory portion 120. In various exemplary, nonlimiting embodiments, a plane of the attachment portion 110 of the platform body 105 is offset from a plane of the accessory portion 120 of the platform body 105. This offset, if included, provides an offset between the user's hip or leg and the accessory portion 120 of the platform body 105. However, it should be appreciated that the inclusion of such an offset is a design choice based upon the desired functionality of the rotatable accessory attachment platform 100. Thus, as illustrated in FIG. 26, a plane of the attachment portion of the platform body 205 is not offset from a plane of the accessory portion of the platform body 205.

An attachment disk opening 111 is formed in the attachment portion 120 of the platform body 105. The attachment disk opening 120 is counter-bored from the first side of the platform body 105, resulting in one or more internal projection(s) 112 that extend into a portion of the attachment disk opening 111. Thus, the attachment disk opening 111 is defined by a first, outer diameter, in the area(s) without the internal projection(s) 112 and a second, inner diameter, in the area(s) that include the internal projection(s) 112. Additionally, the internal projection(s) 112 define a side wall or shoulder 114, facing towards the first side of the platform body 105.

In certain areas, the internal projection(s) 112 extended further into the attachment disk opening 111. These extended areas of the internal projection(s) define notch segments 116 in the attachment disk opening 111.

An accessory disk opening 121 is formed in the accessory portion 120 of the platform body 105. The accessory disk opening 120 is counter-bored from the second side of the platform body 105, resulting in one or more internal projection(s) 122 that extend into a portion of the accessory disk opening 121. Thus, the accessory disk opening 121 is defined by a first, outer diameter, in the area(s) without the internal projection(s) 122 and a second, inner diameter, in the area(s) that include the internal projection(s) 122. Additionally, the internal projection(s) 122 define a side wall or shoulder 124, facing towards the second side of the platform body 105.

In certain areas, the internal projection(s) 122 extended further into the accessory disk opening 121. These extended areas of the internal projection(s) define notch segments 126 in the accessory disk opening 121.

It should be appreciated that because the attachment plate 130 and the accessory plate 150 are interchangeable in certain exemplary embodiments, the overall shape and dimensions of the accessory disk opening 121 and the attachment disk opening 112 are similar and, in most cases, identical.

A release lever receiving slot 118 is formed in a portion of the platform body 105, which extends into at least a portion of the accessory portion 120 and the attachment portion 110. In various exemplary embodiments, the release lever receiving slot formed in the accessory portion 120 is a mirror image of the release lever receiving slot formed in the attachment portion 110. The release lever receiving slot 118 is formed so as to receive at least a portion of a release lever 170. In various exemplary, nonlimiting embodiments, the release lever receiving slot 118 is formed at a position that is approximately 90° to a vertical axis of the platform body 105.

The attachment plate 130 has a substantially circular or disk shape and includes a central portion 132 and an outer rim portion 133. As illustrated, the central portion 132 and the outer rim portion 133 are each sized such that, when the attachment plate 130 is assembled into the platform body 105, the central portion 132 of the attachment plate 130 fits within the portion of the attachment disk opening 111 defined by the internal projection(s) 112 (the inner diameter of the disk openings) and the outer rim portions of the attachment plate 130 fits within the outer diameter of the disk opening 111.

Accordingly, an inner portion of the outer rim portion 133 is capable of rotatably sliding along the surface of the side wall or shoulder 114 of the internal projection(s) 112, while each of the central portions is capable of being maintained within the area defined by the inner diameter created by the internal projection(s) 112. In this manner, the attachment plate 130 is capable of rotating with respect to the platform body 105 while being restrained from being pulled through the respective disk opening by the interaction of the outer rim portion 133 and the side wall or shoulder 114.

The attachment plate 130 optionally includes a stop 136 formed in the back side of the attachment plate 130, extending from the central portion into the outer rim portion. The interaction of notch segments 116 and the stop 136 allows the attachment plate 130 to only rotate a predetermined number of degrees, as dictated predominantly by the length of the notch segment 116. As illustrated herein, the notch segment 116 provides for approximately 90° of rotation. However, it should be appreciated that the notch segment 116 may be formed so as to allow for greater or reduced rotation of the attachment plate 130.

The attachment plate 130 further includes one or more plate apertures 138 formed therethrough. The size and positional relationship of the plate apertures 138 of the attachment plate 130 are such that the attachment plate 130 is capable of interacting with corresponding attachment points or apertures on a belt loop 197, so that the belt loop 197 can be attached, via an attachment means 195, such as, for example, a screw, to the attachment plate 130.

Similarly, the accessory plate 150 has a substantially circular or disk shape and includes a central portion 152 and an outer rim portion 153. As illustrated, the central portion 152 and the outer rim portion 153 are each sized such that, when the accessory plate 150 is assembled into the platform body 105, the central portion 152 of the accessory plate 150 fits within the portion of the accessory disk opening 121 defined by the internal projection(s) 122 (the inner diameter of the disk openings) and the outer rim portions of the accessory plate 150 fits within the outer diameter of the disk opening 121.

Accordingly, an inner portion of the outer rim portion 153 is capable of rotatably sliding along the surface of the side wall or shoulder 124 of the internal projection(s) 122, while each of the central portions is capable of being maintained within the area defined by the inner diameter created by the internal projection(s) 122. In this manner, the accessory plate 150 is capable of rotating with respect to the platform body 105 while being restrained from being pulled through the respective disk opening by the interaction of the outer rim portion 153 and the side wall or shoulder 124.

The accessory plate 150 optionally includes a stop 156 formed in the back side of the accessory plate 150, extending from the central portion into the outer rim portion. The interaction of notch segments 126 and the stop 156 allows the accessory plate 150 to only rotate a predetermined number of degrees, as dictated predominantly by the length of the notch segment 126. As illustrated herein, the notch segment 126 provides for approximately 90° of rotation. However, it should be appreciated that the notch segment 126 may be formed so as to allow for greater or reduced rotation of the accessory plate 150.

The accessory plate 150 further includes one or more plate apertures 158 formed therethrough. The size and positional relationship of the plate apertures 158 of the accessory plate 150 are such that the accessory plate 150 is capable of interacting with corresponding holster body attachment points 192 on a holster 190, so that the holster 190 can be attached, via an attachment means 195, such as, for example, a screw, to the accessory plate 150.

In various exemplary embodiments, the illustrated belt loop 197 includes an attachment platform 198 having one or more attachment apertures 199.

In various exemplary embodiments, the attachment means 195 may comprise screws, snap-together parts, or any other known or later developed means for removably attaching or coupling an item to the attachment plate 130 and/or the accessory plate 150.

In order to secure the belt loop 197 to the rotatable accessory attachment platform 100, the attachment plate 130 is placed within the attachment disk opening 111 (from a first side of the platform body 105) such that the inner surface of the outer rim portion 133 (on a first side of the attachment plate 130) is in contact with the surface of the side wall or shoulder 115. The belt loop 197 (or other attachment device) is abutted to the back of the attachment plate 130 and one or more attachment apertures 199 of the belt loop 197 is/are aligned with apertures 138 of the attachment plate 130.

Once the attachment plate 130 in the belt loop 197 are appropriately aligned, attachment means 195 are used to secure these components by the aligned attachment apertures 199 and apertures 138 such that the platform body 105 is secured between the attachment plate 130 and the belt loop 197.

In order to secure the holster 190 to the rotatable accessory attachment platform 100, the accessory plate 150 is placed within the accessory disk opening 121 (from a second side of the platform body 105) such that the inner surface of the outer rim portion 153 (on a first side of the accessory plate 150) is in contact with the surface of the side wall or shoulder 125. The holster 190 (or other accessory) is abutted to the back of the accessory plate 150 and one or more attachment points 192 of the holster 190 is/are aligned with apertures 158 of the accessory plate 150.

Once the accessory plate 150 in the holster 190 are appropriately aligned, attachment means 195 are used to secure these components by the aligned attachment points 192 and apertures 158 such that the platform body 105 is secured between the accessory plate 150 and the holster 190.

Once assembled, the secured attachment plate 130 and belt loop 197 and the secured accessory plate 150 and holster body 190 are capable of rotating independent of one another with respect to the platform body 105. The rotational range of motion of the combine attachment plate 130, belt loop 197, accessory plate 150, and holster body 190, with respect to the Platform body 105, is dictated by the interaction of the notch segments 116 and 126 and the stops 136 and 156.

As illustrated herein, the rotatable accessory attachment platform 100 includes an exemplary holster 190 being attached to the rotatable accessory attachment platform 100. It should be appreciated that the holster 190 may be any type of holster. Additionally, while a holster 190 is illustrated, it should be understood that the rotatable accessory attachment platform 100 of this invention may be utilized in conjunction with any carrier or holder for any handgun, edged weapon, ammunition magazine, less than lethal product (i.e., a taser, pepper spray, mace canister, baton, or the like), radio, flashlight, cellular telephone, personal digital assistants, or other device.

The release lever 170 comprises at least some of an extended thumb/finger engagement portion 172, an attachment plate engagement portion 174, and an accessory plate engagement portion 175. The plate engagement portion extends from the attachment plate engagement portion 174 to the accessory plate engagement portion 175, such that the plate engagement portion can be simultaneously positioned within the primary notch 135 formed in the attachment plate 130 and the primary notch 155 formed in the accessory plate 150.

The attachment plate engagement portion 174 and the accessory plate engagement portion 175 are generally separated by a fulcrum or pivot pin 178. The thumb/finger engagement portion 172 extends from either the attachment plate engagement portion 174 or the accessory plate engagement portion 175 of the release lever 170.

In various exemplary embodiments, the thumb/finger engagement portion 172 is smooth and non-textured. Alternatively, at least one surface of the thumb/finger engagement portion 172 may include a textured or serrated portion so that the thumb/finger engagement portion 172 may be distinguished tactilely from other portions of the release lever 170 or the platform body 105 and to aid the user's thumb/finger as the user's thumb/finger applies a pivoting force to the release lever 170 and pivots the release lever 170 to a release position.

In various exemplary, non-limiting embodiments, release lever 170 is pivotally connected within a lever receiving slot 118 of the platform body 105, via a fulcrum or pivot pin 178. In various exemplary embodiments, the pivot pin 178 is positioned substantially perpendicular to a vertical axis of the platform body 105. However, it should be appreciated that the pivot pin 178 may be positioned at any angle relative to a vertical axis of the platform body 105.

In various exemplary embodiments, an optional ridge 119 is formed around at least a portion of the release lever 170. Generally, the ridge 119 does not contact the release lever 170, but provides a perimeter around at least a portion of the release lever 170 to reduce the likelihood of the release lever 170 being inadvertently manipulated and to keep items from accidentally snagging or hooking the release lever 170.

The ridge 119 may include a textured portion, such that the ridge 119 may be distinguished tactilely from other portions of the platform body 105 or the release lever 170.

The release lever 170 is pivotable between a locking position and an unlocking position. When the release lever 170 is in the locking position, the attachment plate engagement portion 174 extends into a portion of the attachment disk opening 111 so as to be seated within the primary notch 135 of the attachment plate 130 and the accessory plate engagement portion 175 extends into a portion of the accessory disk opening 121 so as to be seated within the primary notch 155 of the accessory plate 150.

In various exemplary embodiments, the plate engagement portions 174 and 175 may include a ramped or tapered surface on one or both sides of the plate engagement portions 174 and 175. The ramped or tapered surface, if included, may aid in the seating of the plate engagement portions 174 and 175 in the primary notches 135 and 155 and/or the secondary notch 137 and 157.

In various exemplary embodiments, the release lever 170 is biased to the locking position by, for example, a spring means or biasing means 179. In various exemplary embodiments, the spring means or biasing means 179 comprises a portion of spring steel or a spring-biased coil. Alternatively, the spring means or biasing means 179 may comprise an extension or finger that extends from either the release lever 170 or a portion of the body 105 that provides a biasing force to the release lever 170 relative to the body 105.

Figure 15:
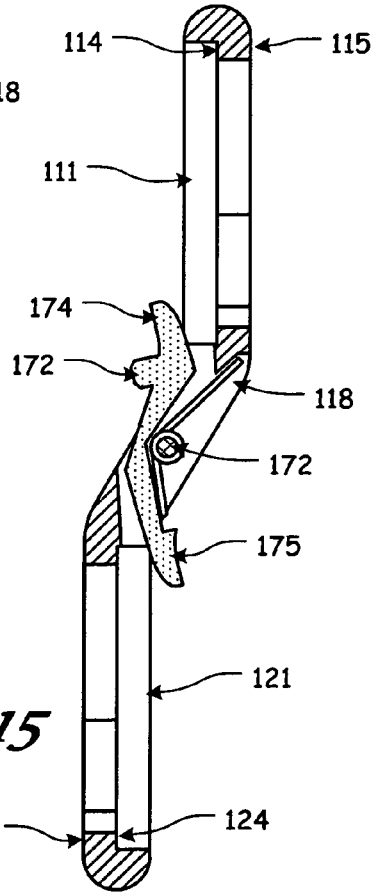
FIG. 15 shows a shows a cross sectional view taken at line 3-3, of FIG. 3, where in the release lever is in the open position.
Figure 16:
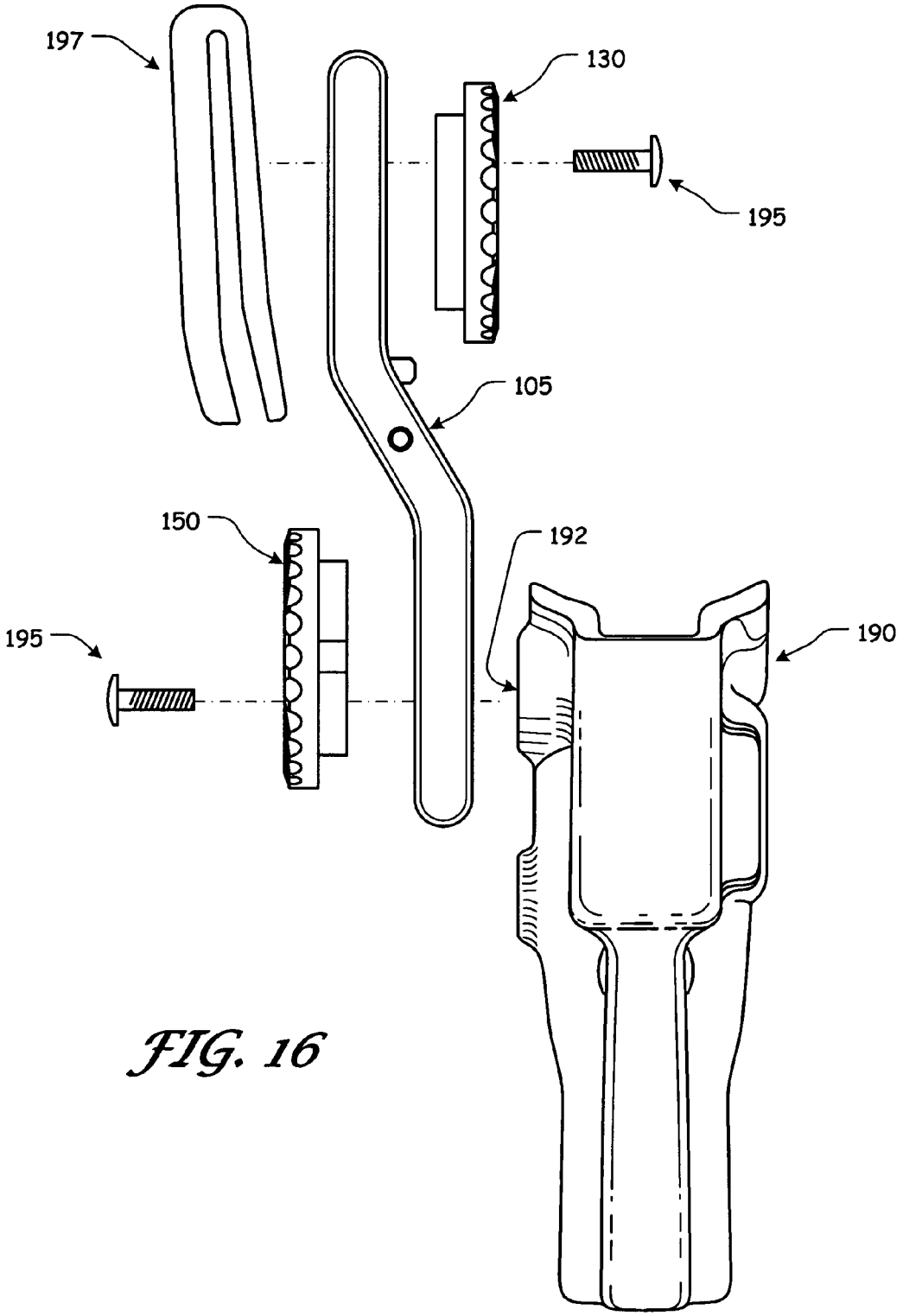
FIG. 16 shows a side view of the constituent components of the first exemplary embodiment of an accessory attachment platform according to this invention, together with an exemplary belt loop and holster.
Figure 17:
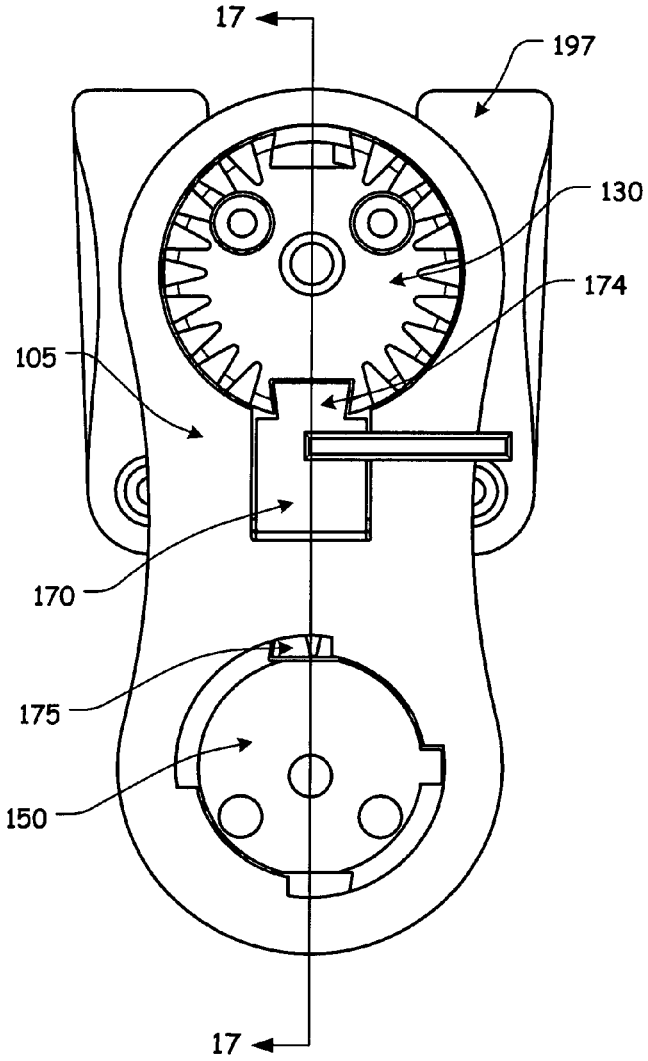
FIG. 17 shows a front view of the rotatable accessory attachment platform, together with an exemplary belt loop, wherein the exemplary holster has been removed to show the accessory plate in an exemplary, carry position.
Figure 18:
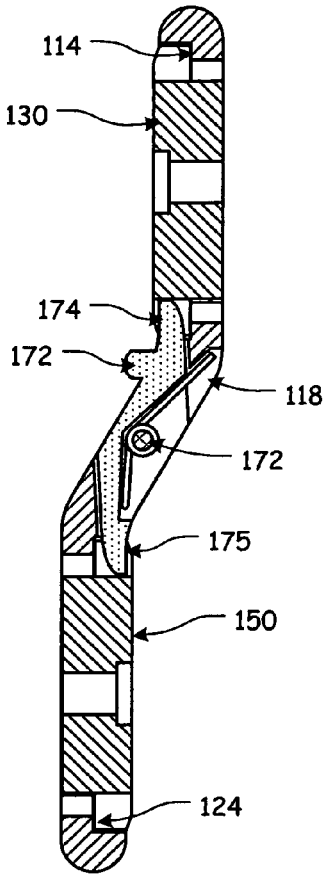
FIG. 18 shows a shows a cross sectional view taken at line 17-17, of FIG. 17, where in the exemplary belt loop has been removed.

When the bias of the release lever 170 is overcome and the release lever 170 is pivoted from the locking position to the unlocking position, the attachment plate engagement portion 174 is withdrawn from the primary notch 135 of the attachment plate 130 and the accessory plate engagement portion 175 is simultaneously withdrawn from the primary notch 155 of the accessory plate 150, as illustrated, for example, in FIG. 15. When the pivoting force is removed from the release lever 170, the release lever 170 returns to the biased locking position, as illustrated for example, in FIG. 14.

At least one primary notch 135 is formed in the attachment plate 130 and at least one primary notch 155 is formed accessory plate 150. In various exemplary embodiments, at least one secondary notch 137 is also formed in the attachment plate 130 and at least one secondary notch 157 is also formed in the accessory plate 150.

The at least one primary notch 135 is formed at a position that allows the plate engagement portion 174 of the release lever 170 to interact with the primary notch 135 when the holster body 190 is in the normal, carry position, as illustrated, for example, in FIG. 1 so as to receive at least a portion of the plate engagement portion 174 of the release lever 170, when the release lever 170 is in the locking position.

The secondary notch 137, if included, is formed at a position that allows the plate engagement portion 174 of the release lever 170 to interact with the secondary notch 137 when the attachment plate 130 or the accessory plate 150 is flipped, or otherwise repositioned to adjust the carry height of the holster or attached accessory.

During use of the rotatable accessory attachment platform 100 (as illustrated with the attached holster 190), the holster 190 is initially presented in an exemplary, carry position, as illustrated in FIG. 1. When in the normal, carry position, the plate engagement portions 174 extends into the primary notches of the attachment plate 130 and the accessory plate 150, such that the attachment plate 130 and the accessory plate 150 are unable to rotate relative to the platform body 105.

If the user desires to rotate the holster 190 from the normal, carry position, the user contacts the thumb/finger engagement portion 172 of the release lever 170, overcomes any bias of the release lever 170, and pivots the release lever 170 from the locking position to the unlocking position.

When the release lever 170 is pivoted from the locking position to the unlocking position, the plate engagement portions 174 of the release lever 170 are withdrawn from the primary notches of the attachment plate 130 and the accessory plate 150, as illustrated in FIG. 15.

Figure 19:
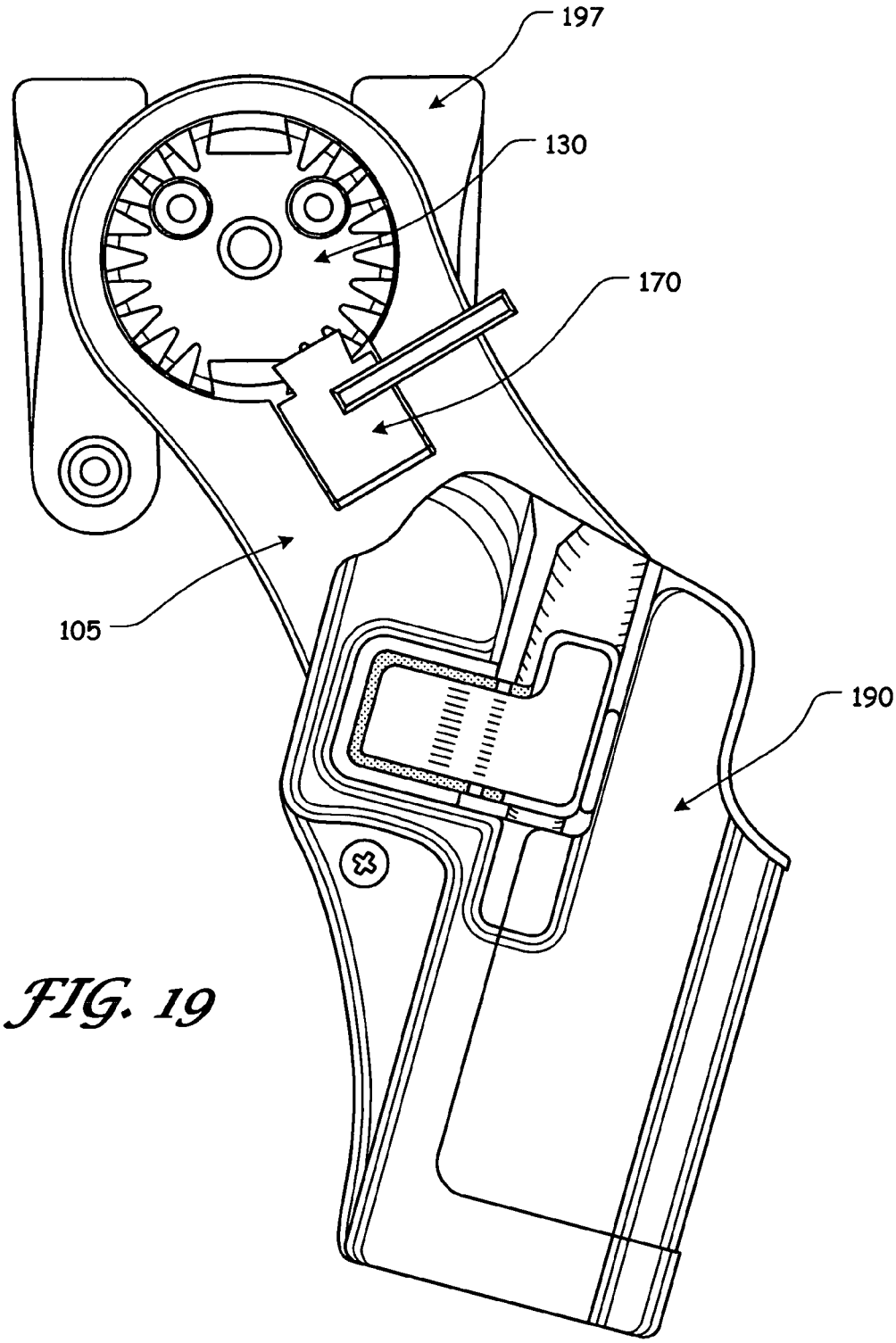
FIG. 19 shows a front view of the rotatable accessory attachment platform, together with an exemplary belt loop and holster, wherein the attached holster is shown in an exemplary, intermediate position.
Figure 20:
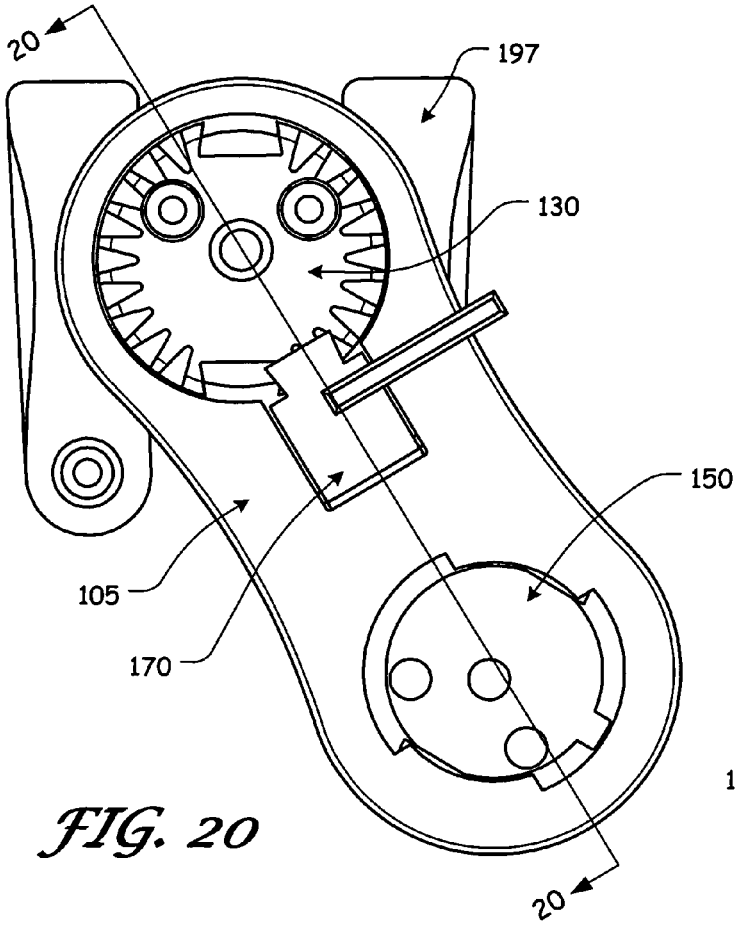
FIG. 20 shows a front view of the rotatable accessory attachment platform, together with an exemplary belt loop, wherein the exemplary holster has been removed to show the accessory plate in an exemplary, intermediate position.
Figure 21:
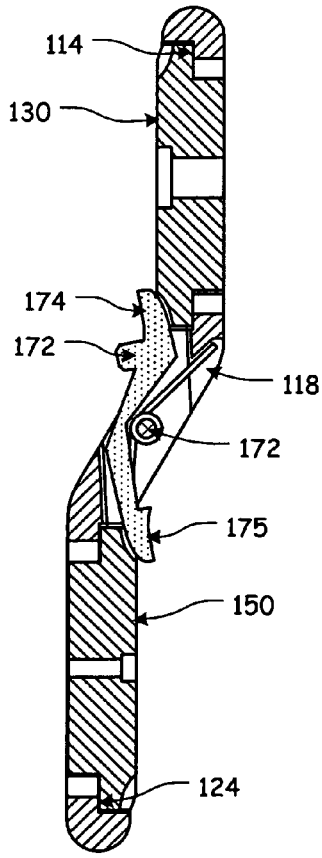
FIG. 21 shows a shows a cross sectional view taken at line 20-20, of FIG. 20, where in the exemplary belt loop has been removed.
Figure 22:
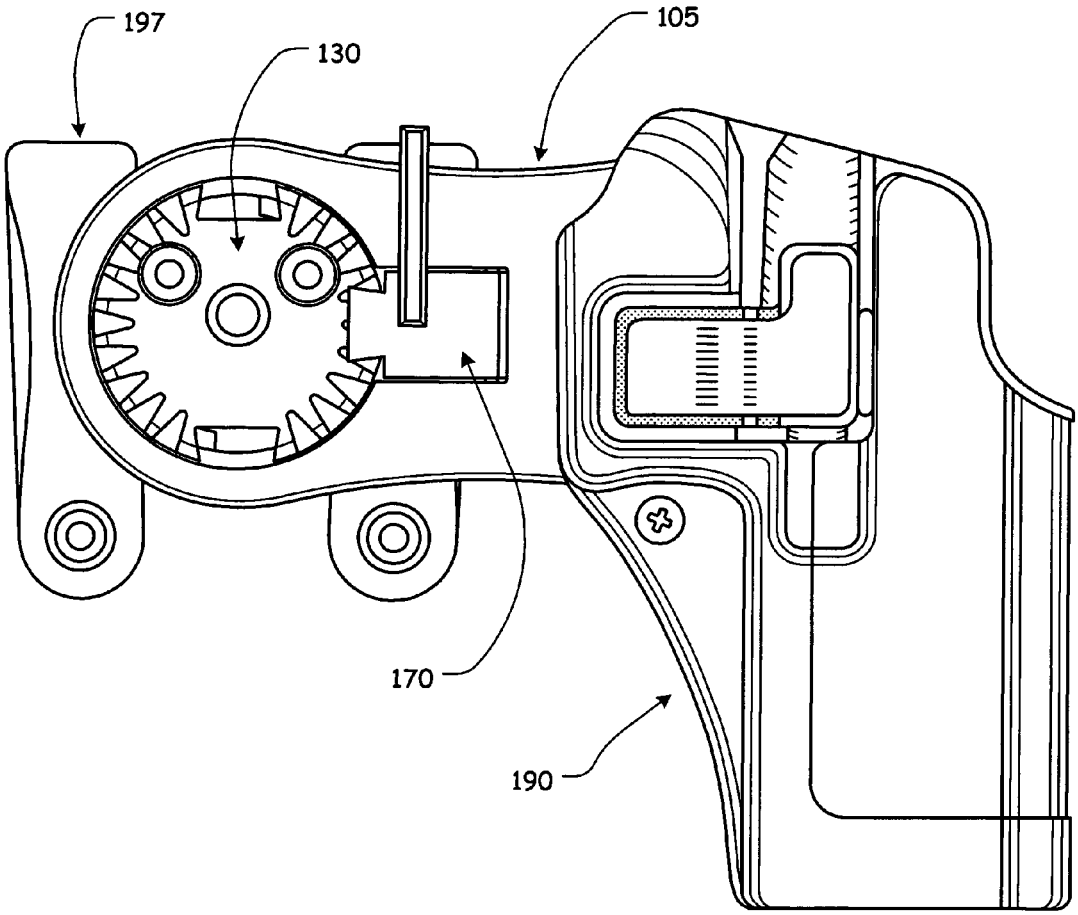
FIG. 22 shows a front view of the rotatable accessory attachment platform, together with an exemplary belt loop and holster, wherein the attached holster is shown in an exemplary, rotated or angular position, being rotated forward and upward from an exemplary, carry position.
Figure 23:
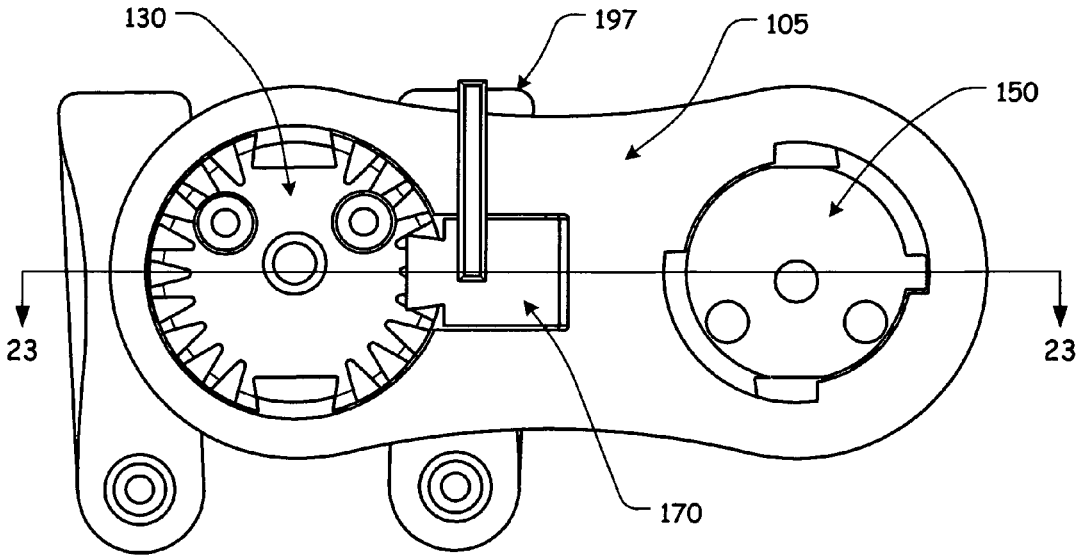
FIG. 23 shows a front view of the rotatable accessory attachment platform, together with an exemplary belt loop, wherein the exemplary holster has been removed to show the accessory plate in an exemplary, rotated or angular position.
Figure 24:
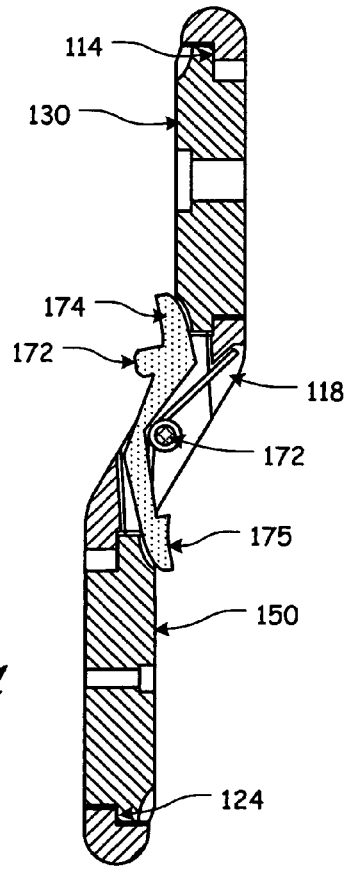
FIG. 24 shows a shows a cross sectional view taken at line 23-23, of FIG. 23, where in the exemplary belt loop has been removed.
Figure 25:
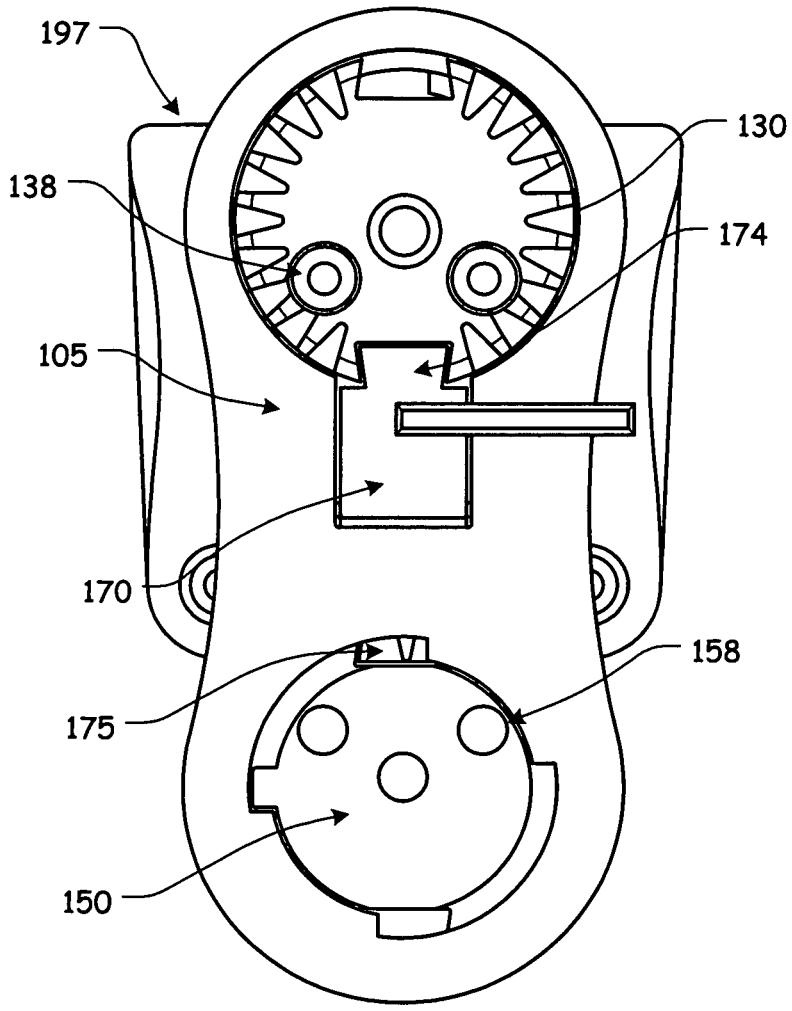
FIG. 25 shows a front view of the rotatable accessory attachment platform, together with an exemplary belt loop, wherein the accessory plate and attachment plate have been repositioned in order to optionally alter that carry height of the attachment plate relative to the accessory plate.

As illustrated in FIG. 19, once the plate engagement portions 174 of the release lever 170 are sufficiently withdrawn from the primary notches 135, the holster 190 may be rotated relative to the platform body 105. At the same time, the platform body 105 may be rotated relative to the belt loop 197.

Once the holster 190 and/or platform body 105 has been rotated from the normal, carry position and the pivoting force is removed from the release lever 170, the release lever 170 returns to the biased locking position.

In various exemplary embodiments, the attachment plate 130 and the accessory plate 150 each include a number of stop position detents, or its secondary notches 137 and 157, respectively, spaced around an outer portion of the first side of the attachment plate 130 and the accessory plate 150. The secondary notches 137 and 157, if included, are formed such that the attachment plate engagement portion 174 and accessory plate engagement portion 175 can engage the secondary notches 137 and 157 when the pivoting force is removed from the release lever 170.

Depending on the depth and/or shape of the secondary notches 137 and 157, the plate engagement portions may only extend far enough into the secondary notches 137 and 157 to loosely maintain the attachment plate 130 and/or the accessory plate 150 in a rotated position provided by a particular secondary notches 137 and 157. If the plate engagement portions only loosely maintain the attachment plate 130 and/or the accessory plate 150 in a particular rotated position, a user may simply apply a counter rotating force to the holster 190 or the platform body 105 to overcome the bias of the release lever 170, force the plate engagement portion 174 from the secondary notches 137 and 157, and allow the holster 190 or the platform body 105 to be rotated to the normal, carry position.

It should be appreciated that the secondary notches 137 and 157, if included, allow the attachment plates to be engaged by the release lever 170 at various, predetermined points. Therefore, utilizing additional secondary notches 137 and 157, the holster body 190 and/or the platform body 105 may be maintained in a variety of rotational or angular positions, relative to the belt loop 197 or other attachment device.

It should be appreciated that when the attachment plate 130 and the accessory plate 150 are of a similar size and shape and when the one or more plate apertures 138 and 158 formed primarily in an upper or lower area of the attachment plate 130 and the accessory plate 150, respectively, the attachment plate 130 and/or the accessory plate 150 may optionally be flipped, or otherwise repositioned to adjust the carry height of the holster or attached accessory.

Figure 27:
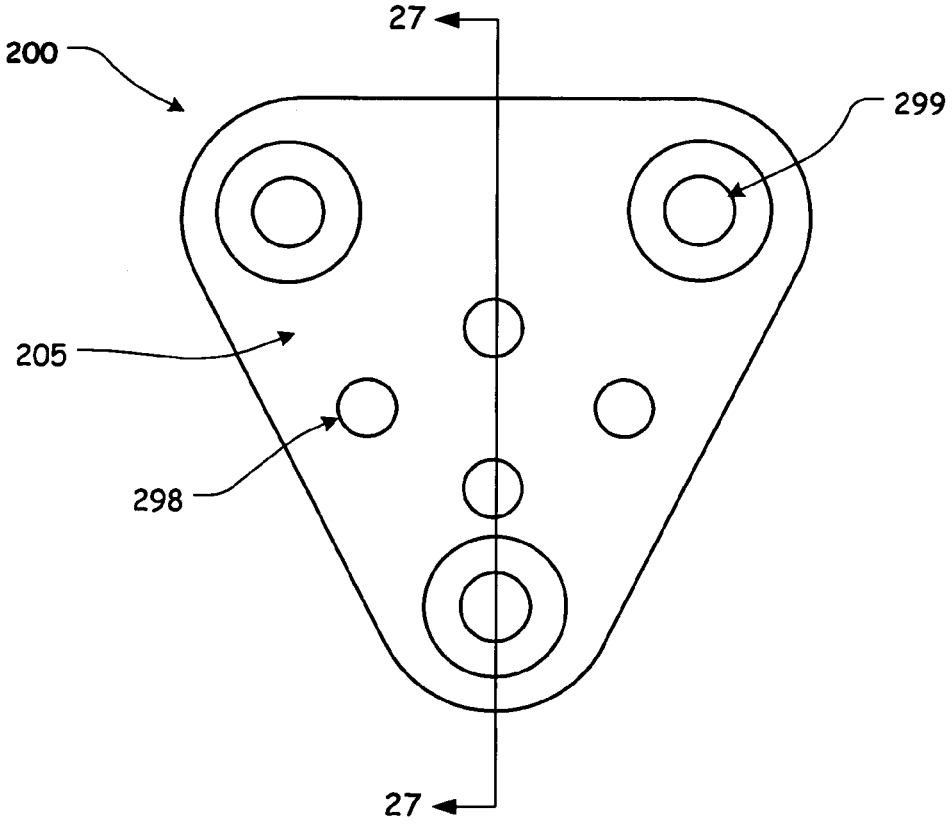
FIG. 27 shows a front view of an exemplary embodiment of an adapter plate to be used with the present invention.
Figure 28:
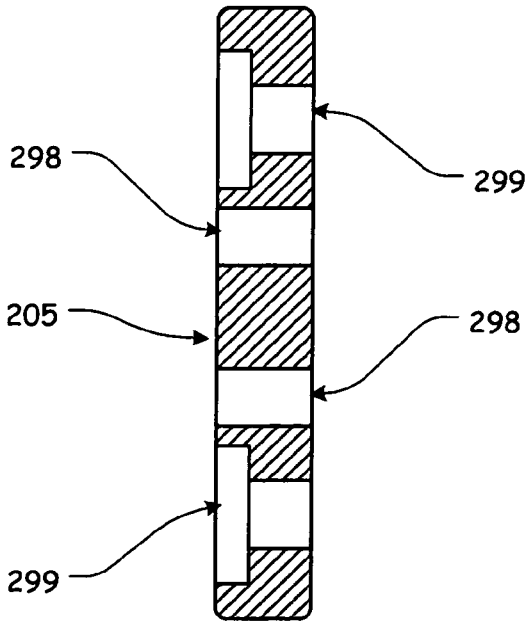
FIG. 28 shows cross sectional view taken at line 27-27, of FIG. 27.

FIGS. 27 and 28 show an exemplary embodiment of an adapter plate 200 to be used with the present invention.

While this invention has been described in conjunction with the exemplary embodiments outlined above, it is evident that many alternatives, modifications, and variations will be apparent to those skilled in the art.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. An accessory attachment platform, comprising:

a platform body, wherein the platform body comprises a first side and a second side, wherein the platform body extends, along a longitudinal axis, from an upper, attachment portion to a lower, accessory portion;

wherein the attachment portion includes an attachment disk aperture formed therethrough, wherein the attachment disk aperture is counter-bored from a first side of the platform body, resulting in at least one internal projection that extends into a portion of the attachment disk aperture and defines a first shoulder, facing towards the first side of the platform body;

wherein the accessory portion includes an accessory disk aperture formed therethrough, wherein the accessory disk aperture is counter-bored from a first side of the platform body, resulting in at least one internal projection that extends into a portion of the accessory disk aperture and defines a second shoulder, facing towards the second side of the platform body;

at least a portion of an attachment plate portion extending through the attachment disk aperture and at least a portion of an accessory plate portion extending through the accessory disk aperture, such that the attachment plate portion and the accessory plate portion are each independently rotatable relative to the platform body, wherein an outer rim portion of the attachment plate portion is rotatably slidable along a surface of the first shoulder and wherein an outer rim portion of the accessory plate portion is rotatably slidable along a surface of the second shoulder; and a release lever pivotably positioned within a release lever receiving slot of the platform body, wherein the release lever is pivotable between a locking position and an unlocking position, and wherein the release lever is capable of simultaneously releasably interacting with a primary notch of the attachment plate portion and a primary notch of the accessory plate portion such that when the release lever is in the locking position, the attachment plate portion and the accessory plate portion are unable to rotate relative to the platform body.

2. An accessory attachment platform, comprising:

a platform body, wherein the platform body comprises a first side and a second side, wherein the platform body extends, along a longitudinal axis, from an upper, attachment portion to a lower, accessory portion, wherein an attachment disk aperture is formed through the attachment portion of the platform body, and wherein an accessory disk aperture is formed through the accessory portion of the platform body;

an attachment plate, wherein at least a portion of the attachment plate is positioned within the attachment disk aperture;

an accessory plate, wherein at least a portion of the accessory plate is positioned within the accessory disk aperture; and a release lever, wherein the release lever is pivotably positioned within a release lever receiving slot of the platform body, wherein the release lever comprises an extended thumb/finger engagement portion, an attachment plate engagement portion, and an accessory plate engagement portion, and wherein the release lever is capable of being pivoted from a closed position wherein the attachment plate engaging portion engages the attachment disk and wherein the accessory plate engaging portion engages the accessory disk.

3. The accessory attachment platform of claim 2, wherein the attachment disk aperture includes one or more internal projections that extend into a portion of the attachment disk aperture.

4. The accessory attachment platform of claim 2, wherein a plane of the attachment portion of the platform body is offset from a plane of the accessory portion of the platform body.

5. The accessory attachment platform of claim 2, wherein a plane of the attachment portion of the platform body is substantially parallel to a plane of the accessory portion of the platform body.

6. The accessory attachment platform of claim 2, wherein the attachment disk aperture is counter-bored from the first side of the platform body.

7. The accessory attachment platform of claim 2, wherein the attachment disk aperture is defined by a first, outer diameter, in areas without the internal projections and a second, inner diameter, in areas that include the internal projection.

8. The accessory attachment platform of claim 2, wherein the internal projections define a shoulder, facing towards the first side of the platform body.

9. The accessory attachment platform of claim 2, wherein the internal projections extended into the attachment disk aperture to define notch segments in the attachment disk aperture.

10. The accessory attachment platform of claim 2, wherein the accessory disk aperture includes one or more internal projections that extend into a portion of the accessory disk aperture.

11. The accessory attachment platform of claim 2, wherein the accessory disk aperture is counter-bored from the second side of the platform body.

12. The accessory attachment platform of claim 2, wherein the accessory disk aperture is defined by a first, outer diameter, in areas without the internal projections and a second, inner diameter, in areas that include the internal projections.

13. The accessory attachment platform of claim 2, wherein the internal projections define a shoulder, facing towards the first side of the platform body.

14. The accessory attachment platform of claim 2, wherein the internal projections extended into the accessory disk aperture to define notch segments in the accessory disk aperture.

15. An accessory attachment platform, comprising:

having an accessory portion and an attachment portion, wherein the accessory portion includes an accessory disk aperture formed therethrough and the attachment portion includes an attachment disk aperture formed therethrough an attachment plate portion and an accessory plate portion, wherein the attachment plate portion and the accessory plate portion are rotatable relative to the platform body; and a release lever pivotably attached to the platform body, wherein the release lever is pivotable between a locking position and an unlocking position, and wherein the release lever is capable of releasably interacting with a primary notch of the attachment plate portion such that when the release lever is in the locking position relative to the primary notch of the attachment plate portion, the attachment plate portion is unable to rotate relative to the platform body.

* * * * *

UNITED STATES PATENT AND TRADEMARK OFFICE

CERTIFICATE OF CORRECTION

PATENT NO. : 8,783,532 B2
APPLICATION NO. : 13/519381
DATED : July 22, 2014
INVENTOR(S) : Thomas M. Gregory et al.

It is certified that error appears in the above-identified patent and that said Letters Patent is hereby corrected as shown below:

In the Claims

Claim 15, Column 12, Line 37, insert --a platform body-- before the phrase "having an accessory portion".

Claim 15, Column 12, Line 41, insert --;-- after "therethrough".

Signed and Sealed this
Second Day of December, 2014

Michelle K. Lee

Michelle K. Lee
*Deputy Director of the United States Patent and Trademark Office*